United States Patent [19]

Amagaya

[11] Patent Number: 4,791,725

[45] Date of Patent: Dec. 20, 1988

[54] SHEATHED SCISSORS

[75] Inventor: Hidefumi Amagaya, Tokyo, Japan

[73] Assignee: Plus Corporation, Tokyo, Japan

[21] Appl. No.: 31,606

[22] Filed: Mar. 30, 1987

[30] Foreign Application Priority Data

Dec. 3, 1986 [JP] Japan ..... 61-186608[U]

[51] Int. Cl.[4] ..... B26B 13/00

[52] U.S. Cl. ..... 30/154; 30/162; 30/252; 30/254; 30/255

[58] Field of Search ..... 30/254, 255, 245, 252, 30/234, 135, 155, 154, 162, 253

[56] References Cited

U.S. PATENT DOCUMENTS 4,502,220 3/1985 Aoki ..... 30/162 X

*Primary Examiner*—Douglas D. Watts

*Attorney, Agent, or Firm*—McAulay, Fields, Fisher, Goldstein & Nissen

[57] ABSTRACT

A pair of scissors having a pair of blades which are slidingly fitted between a pair of handles which are pivotally supported one on the other. The blades are drawn out when the scissors are used, and they are accommodated between the handles when the scissors are not used, thus enabling the scissors to be easily carried.

5 Claims, 3 Drawing Sheets

SHEATHED SCISSORS

BACKGROUND OF THE INVENTION

This invention relates to a pair of scissors which are convenient when bing carried and which are designed to be used by drawing out the blades from the handles, the blades being accommodated in the handles when the scissors are not used.

Conventional type of scissor have blades and handles integrally with each other, and it is necessary to prepare a container such as a sack or box to prevent a person who carries this type of scissors from being injured by the blades.

SUMMARY OF THE INVENTION

It is therefore an object of the present invention to provide a pair of scissors which are convenient and safe when being carried.

To this end, the present invention provides a pair of scissors in which the blades are incorporated in the handles and which are used by drawing out the blades from handles, the blades being accommodated in the handles when the scissors are not used.

BRIEF DESCRIPTION OF THE DRAWINGS

The accompanying drawings show a pair of scissors which represents one embodiment of the present invention.

DETAILED DESCRIPTION OF THE PREFERRED EMBODIMENT

Figure 1:
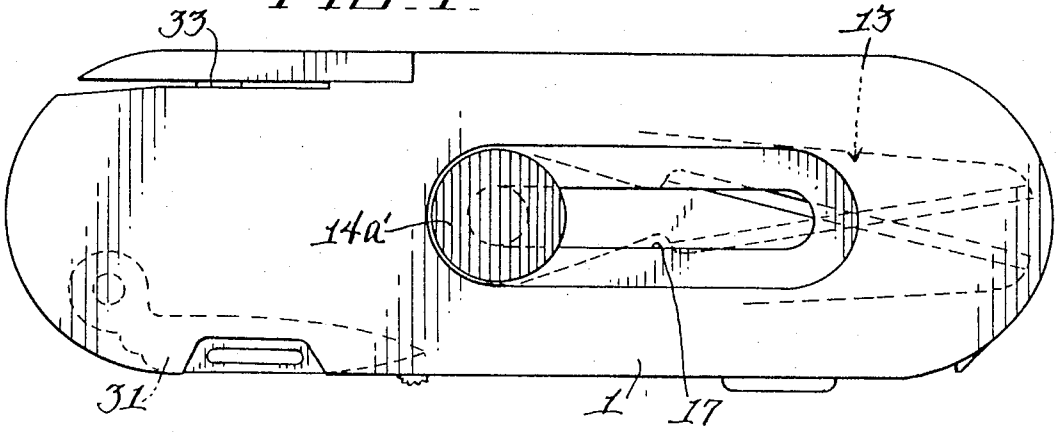
FIG. 1 is a front view of the scissors.
Figure 2:
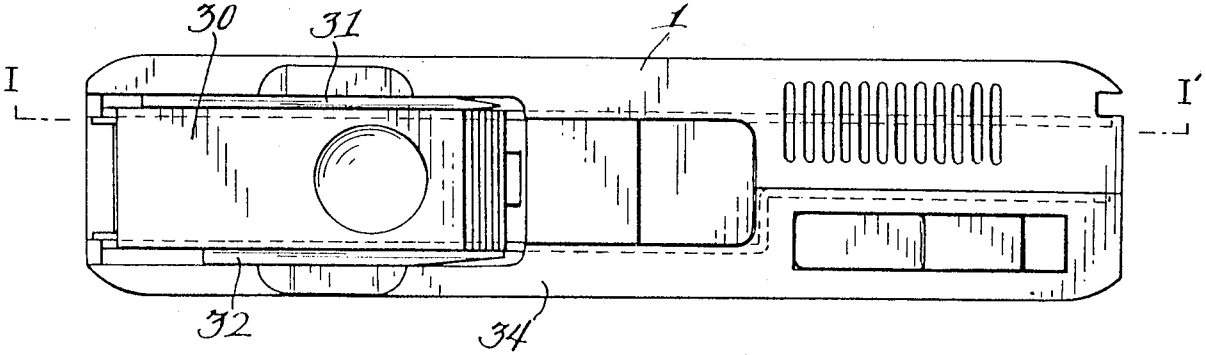
FIG. 2 is a bottom view of the scissors.
Figure 3:
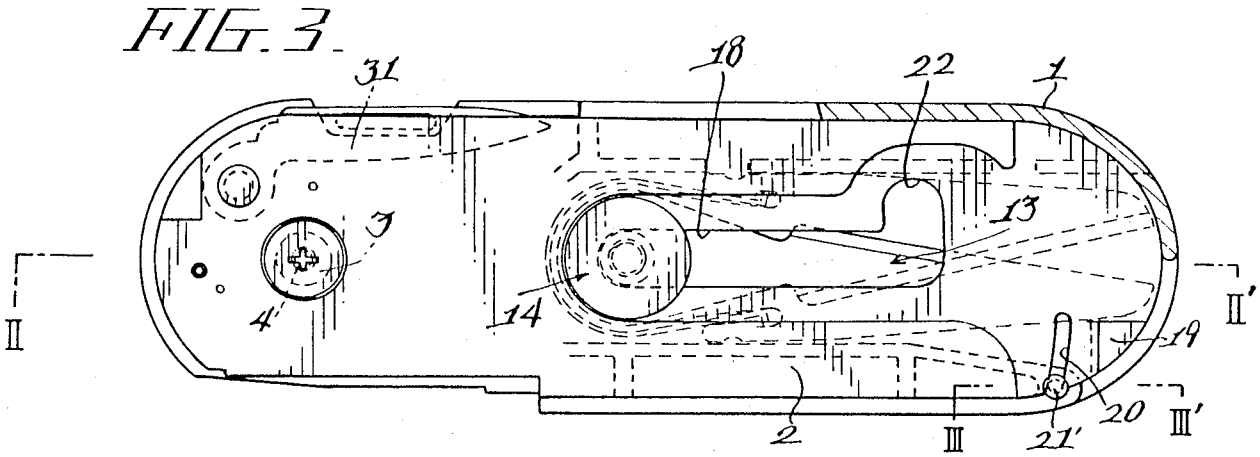
FIG. 3 is a cross-sectional view taken along a line I—I' of FIG. 2.
Figure 4:
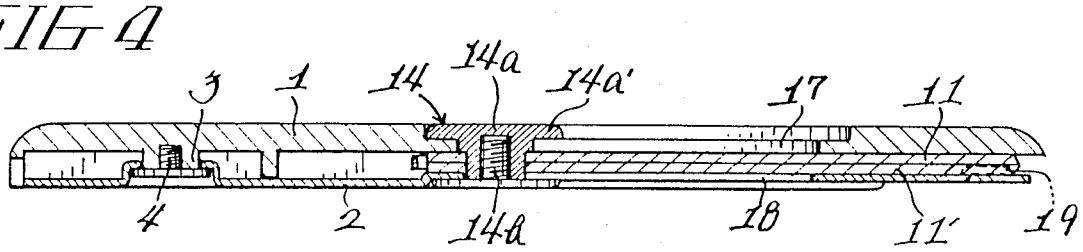
FIG. 4 is a cross-sectional view taken along a line II—II' of FIG. 2.
Figure 5:
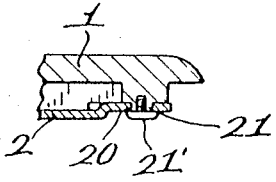
FIG. 5 is a cross-sectional view taken along a line III—III of FIG. 3.
Figure 7:
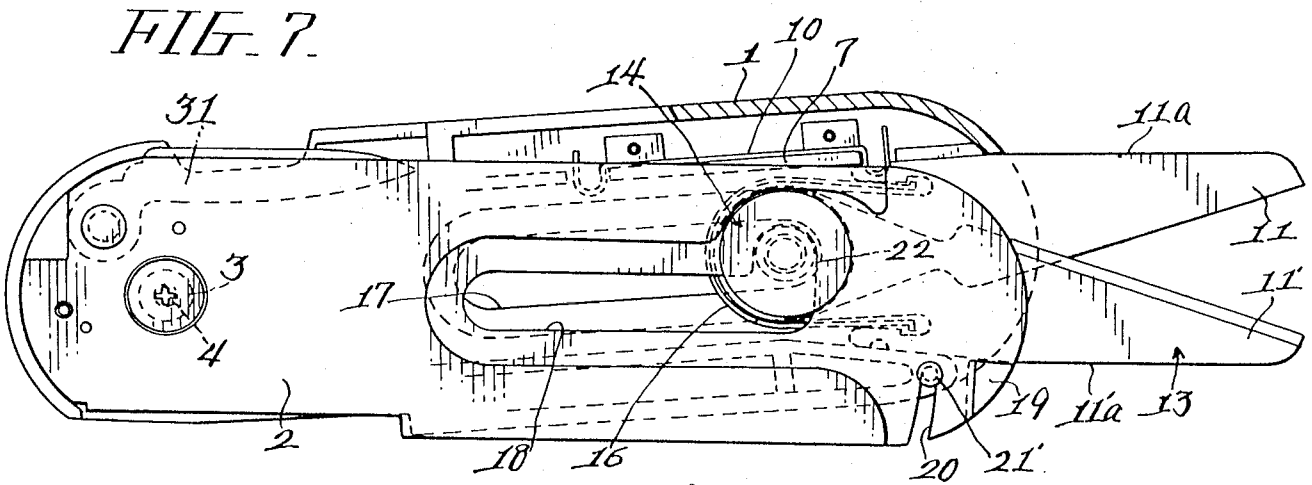
FIG. 7 is a partially cutaway side view of the scissors in a used state.
Figure 6:
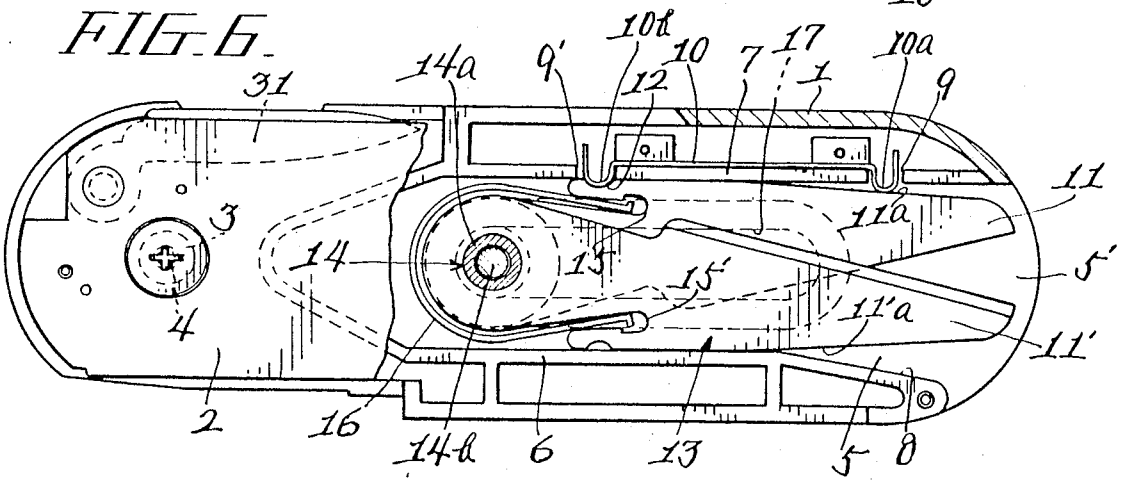
FIG. 6 is a partially cutaway side view of the scissors.

The present invention will be described below in detail with reference to the accompanying drawings which show a pair of scissors which represents an embodiment of the present invention.

A first and second handles 1 and 2 pivotally supported by a support shaft 3 which is disposed at the rear of the first handle 1 and into which the top of a screw 4 which passes through the second handle 2 is screwed.

An accommodation gap 5 which is open at an opening 5' formed at the side of the top ends o the handles 1 and 2 is formed on the inner surface of the first handle 1, that is, the surface which faces the second handle 2, between a pair of contacting rib projections 6 and 7 which are formed on the first handle 1 such as to be parallel with each other. The contacting rib 6 has a slanted rib portion 8 which increases the longitudinal dimension of the gap 5 near the opening 5'.

The contacting rib 7 has discontinuities 9 and 9' formed at its front and rear portions at a desired interval. End portions 10*a* and 10*d* of a spring plate 10, which is attached to the first handle 1, are fitted into the discontinuities 9 and 9' such as to project into the accommodation gap 5.

The spring end portions 10*a* and 10*d* are engaged with a recess 12 formed in the back 11*a* of a blade 11 and have the function of positioning a blade assembly 13 when the same is accommodated or when it is used after being drawn out from the handles 1 and 2.

The blade assembly is constituted by a pair of blades 11 and 11' which are pivotally supported at their rear portions by a main shaft 14 stretched between the first and second handles 1 and 2 so that the blades 11 and 11' can be opened and closed at the side of their tips. A spring 16 is engaged with at its opposite ends with slits 15 and 15' formed in the backs 11*a* and 11*a'*, thereby urging the blades 11 and 11' to open.

The blade assembly 13 is fitted into the accommodation gap 5 formed in the first handle while being pinched between the contacting ribs 6 and 7 which act to limit the extent to which the blades are opened by the urging force of the spring 16. The main shaft 14 which is constituted by a nut member 14*a* and a screw 14*b* of the blade assembly 13 is engaged with elongated holes 17 and 18 formed in the first and second handles 1 and 2. The blade assembly 13 is slid along the elongated holes 17 and 18 when operated at the head 14*a'* of the main shaft nut 14*a* or an operational member which is exposed at the side of the first handle 1.

A top contacting projection 19 which is engaged with the back 11*a'* of the blade 11' is formed on the top of the second handle 2 in the accommodation gap opening 5' at the side of the slanted rib portion 8 formed on the first handle 1.

A slit 20 is formed in the second handle 2 in the vicinity of the top contacting projection 19 such as to extend in the same direction as that in which the second handle 2 is turned about the support shaft 3. A guide member 21 having a head 2l' whose diameter is larger than the width of the slit 20 is attached to the first handle 1 so that it projects therefrom to pass through the slit 20.

In this embodiment, a screw is attached to the guide member 21 to form the head 21 thereof, but otherwise the entire part of the guide member may be provided in the form of a screw.

An engaging edge 22 is formed at the top of the elongated hole 18 in the second handle 2 such as to be recessed at a side opposite to the side of the top contacting projection 19.

The scissors in accordance with the present invention are thus constructed. The operation thereof is as follows. When the main shaft 14 is slid along the elongated holes 17 and 18 by operating the head 14*a'* of the main shaft nut 14*a*, the blade assembly 13 moves to the opening 5' of the accommodation gap 5 and projects from the same so that it is extended by the spring 16 because of the existence of the slanted rib portion 8. Then the main shaft 14 is engaged with the engaging edge 22, and the spring end portion 10*a* formed at a front portion of the accommodation gap 5 is engaged with the recess 12, thereby inhibiting the movement of the blade assembly 13 in the direction of the accommodated position.

After the blade 11 has stopped on the contacting rib 7 while the blade 11' is in contact with the top contacting projection 19, the handles 1 and 2 are turned about the main shaft 3, thereby effecting cutting operation.

When the nut member head 14*a'* is operated to return the blade assembly to the initial position, the spring end portion 10*b* is engaged with the recess 12 so that the movement of the blade assembly 13 in the direction of the projection from the accommodation gap 5 is positively limited.

The scissors shown in the drawings represents an example of a multipurpose stationery device in accordance with the present invention in which a stapler 30, a knife 31, a remover 32 and other devices (not shown) such as a punch, a lens, a tape measure, an adhesive tape, and so forth are suitably accommodated in the handles 1 and 2. In the accompanying drawings, a reference numeral 33 denotes a punching rod of the punch, and a reference numeral 34 denotes a cover disposed at the side of the second handle 2.

The scissors in accordance with the present invention is constructed as described above. It can be used as desired by drawing out blades from the handles and can be carried after the blades have been accommodated in the handles.

What is claimed is:

1. A pair of scissors comprising: a pair of handles, first pivot means for pivotally connecting said pair of handles together, a pair of blades, second pivot means for pivotally connecting together said pair of blades, sliding means for mounting said blades between said handles for movement between a retracted and an extended position, a spring engaging said blades to bias said blades to the open position when said blades are in the extended position, and projections on each one of said pair of handles engageable with a respective one of said blades for operating said blades about said second pivot means when said handles are pivoted with respect to each other about said first pivot means.

2. A pair of scissors according to claim 1, further comprising: a slit formed in one of said handles near the top end thereof, said slit extending in the same direction as that in which said one of said handles pivots relative to the other one of said handles; and a guide member having a head whose outside diameter is larger than the width of said slit, said guide member being formed on said other one of said handles so as to project therefrom to pass through said slit.

3. A pair of scissors according to claim 1, further comprising a pair of slits formed in the backs of said pair of blades, said pair of slits being engaged with the opposite ends of said spring for extending said blades.

4. A pair of scissors according to claim 1, further comprising: an accommodation gap open at the top of said handles, said accommodation gap being formed in one of said pair of handles between a pair of contacting projections one of which constitutes one of said contacting projections and which extend from an inner part of said accommodation gap to the opening thereof such as to be parallel with each other, said pair of blades being fitted into said slid between said pair of contacting projections, one of said pair of contacting projections having a slanted portion which increases the longitudinal dimension of said opening of said accommodation gap; a top contacting projection which constitutes the other one of said contacting projections formed on said other one of said pair of handles and which contacts one of said blades on the side of said slanted portion; elongated holes respectively formed in said pair of handles, said elongated holes engaging with the main pivot shaft of said blades; and an engaging edge formed at the top of one of said elongated holes of said other one of said handles such as to be recessed at the side thereof opposite to that of said top contacting projection, said engaging edge being engaging with said main pivot shaft.

5. A pair of scissors according to claim 1, wherein a support shaft which pivotally supports said pair of handles is disposed at the rear of said pair of blades.

* * * * *